US005437567A

United States Patent [19]

Peterson

[11] Patent Number: 5,437,567

[45] Date of Patent: Aug. 1, 1995

[54] FEMALE ELECTRICAL TERMINAL

[75] Inventor: Bruce A. Peterson, Schaumburg, Ill.

[73] Assignee: Molex Incorporated, Lisle, Ill.

[21] Appl. No.: 104,223

[22] Filed: Aug. 9, 1993

[51] Int. Cl.[6] ..... H01R 13/62

[52] U.S. Cl. ..... 439/851; 439/842

[58] Field of Search ..... 439/842, 843, 851-857, 439/861, 862, 381

[56] References Cited

U.S. PATENT DOCUMENTS

| | | | |
|---|---|---|---|
| 2,759,165 | 8/1956 | Batcheller | 439/849 |
| 3,152,856 | 10/1964 | Batcheller | 439/849 |
| 3,550,069 | 12/1970 | Zeagno | 439/849 |
| 4,415,221 | 11/1983 | Inoue et al. | 439/849 |
| 4,466,684 | 8/1984 | Grant et al. | 439/857 |
| 4,540,233 | 9/1985 | Saijo et al. | 339/258 R |
| 4,681,393 | 7/1987 | Fukishima et al. | 439/851 |
| 4,721,484 | 1/1988 | Sakamoto et al. | 439/842 |

FOREIGN PATENT DOCUMENTS

| | | | |
|---|---|---|---|
| 2725183 | 5/1990 | United Kingdom | 439/851 |

*Primary Examiner*—David L. Pirlot
*Attorney, Agent, or Firm*—Stephen Z. Weiss

[57] ABSTRACT

A generally elongate female electrical terminal includes an improved torsional mating portion having a terminal-receiving passageway adapted to receive a male terminal. The mating portion includes two longitudinally spaced generally U-shaped cross sectional portions defining the front and rear of the passageway. Each U-shaped cross sectional portion is defined by a pair of legs joined by a bight portion. Two spaced apart side walls extend lengthwise of the passageway and connect the legs of the cross sectional portions. Each side wall has two longitudinally spaced, inwardly projecting dimples for engaging the male terminal received in the passageway. A bottom wall extends generally perpendicular from one of the side walls toward the other side wall. A free end of the bottom wall forms a transverse opening with the other side wall intermediate the U-shaped cross sectional portions. The front and rear of the bottom wall are spaced from the cross sectional portions. The side walls are flexed outwardly away from each other about generally longitudinal axes when a male terminal is inserted into the passageway. The bottom wall flexes upwardly to bias the male terminal in a more centered alignment with the dimples.

3 Claims, 3 Drawing Sheets

FEMALE ELECTRICAL TERMINAL

FIELD OF THE INVENTION

This invention generally relates to the art of electrical connectors and, particularly, to a female or socket-type electrical terminal.

BACKGROUND OF THE INVENTION

A wide variety of mating electrical connectors employ pairs of interengaging pin and socket terminals for interconnecting a plurality of circuits or wires through the mated connectors. The pin and socket terminals often are called male and female terminals.

One type of female terminal includes a generally rectangular socket or receptacle at its mating end for receiving a generally rectangular pin or male terminal. The mating end is formed by an elongate body defining top and bottom walls and opposite cantilevered side walls. The terminal conventionally is stamped and formed from sheet metal material, and the top and bottom walls have open seams or slits, whereby the opposite side walls can flex about axes generally perpendicular to the elongated axis of the terminal. This type of flexing has created some problems.

For instance, it is common to form dimples in the opposite side walls at the mating end of the female terminal for establishing a more positive contact with an inserted male or pin terminal. Preferably, a pair of longitudinally spaced contacting dimples are formed on each flexible side wall. Unfortunately, since the side walls flex about axes which are generally perpendicular to the longitudinal axis of the terminal, and since the dimples in each pair are spaced longitudinally of the terminal, when the male terminal is fully inserted there is unequal pressure applied by the contacting dimples. In fact, the endmost dimple in each longitudinally spaced pair often establishes little contacting pressure. This leads to further complications when the dimples are plated with a highly conductive material, such as gold. Uneven wear occurs on the dimples, and the gold plating actually can wear off of one of the contacting dimples before the other.

A further problem involves centering of the inserted male terminal which has a tendency to seat in the bottom of the mating end of the female terminal. Since the opposite side walls of the split mating end of the female terminal pivot about axes generally perpendicular to the longitudinal axis of the terminal, no provisions can be made at the mating end to facilitate centering of the male terminal in the female terminal.

This invention is directed to solving the problems identified above and satisfying a need for an improved elongate female electrical terminal.

SUMMARY OF THE INVENTION

An object, therefore, of the invention is to provide a new and improved female electrical terminal of the character described.

In the exemplary embodiment of the invention, the female terminal is elongate and includes an improved torsional mating portion, or end, having a terminal-receiving passageway adapted to receive a male terminal. The mating portion includes two longitudinally spaced, generally U-shaped cross sectional portions defining the front and rear of the passageway. Each U-shaped cross sectional portion is defined by a pair of legs joined by a bight portion.

According to one aspect of the invention, two spaced apart side walls extend lengthwise of the passageway and connect the legs of the cross sectional portions. Each side wall has a pair of longitudinally spaced, inwardly projecting terminal contacting dimples for engaging a male terminal received in the passageway. The distance between the dimples of the opposite side walls is less than the width of the male terminal. As the male terminal is inserted into the mating portion of the female terminal, the side walls flex about axes generally parallel to the longitudinal axis of the female terminal, whereby all of the terminal-contacting dimples apply uniform pressure on the male terminal.

According to another aspect of the invention, a bottom wall extends generally perpendicular from one of the side walls toward the other side wall, with a free end of the bottom wall forming a transverse opening with the other side wall between the U-shaped cross sectional portions. The front and rear of the bottom wall are spaced from the cross sectional portions. Therefore, when a male terminal is inserted into the passageway, the side walls flex about their longitudinal axes and the free end of the bottom wall flexes upwardly to force the male terminal upwardly to a more centered alignment with the terminal contacting dimples.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
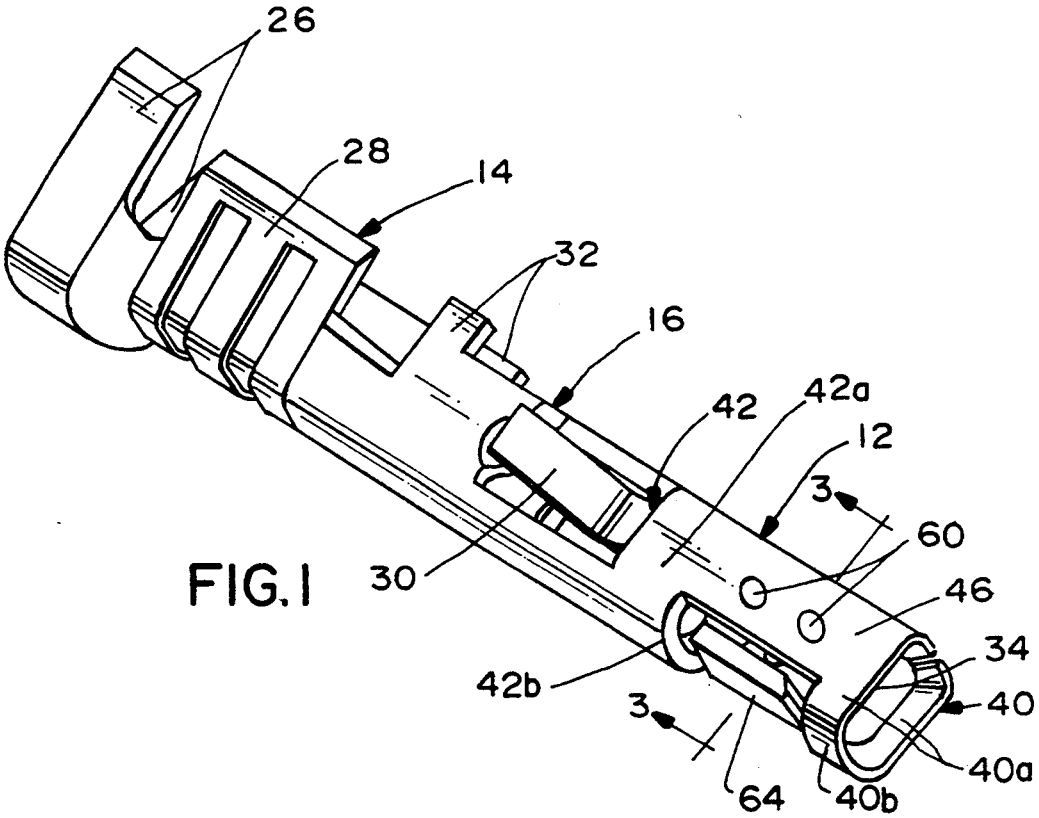
FIG. 1 is a perspective view of a female electrical terminal incorporating the concepts of the invention.

Referring to the drawings in greater detail, and first to FIG. 1, the invention is incorporated in a generally elongate female electrical terminal, generally designated 10. The female terminal includes a mating portion or end, generally designated 12, a terminating portion or end, generally designated 14, and an intermediate securing portion or section, generally designated 16.

Figure 2:
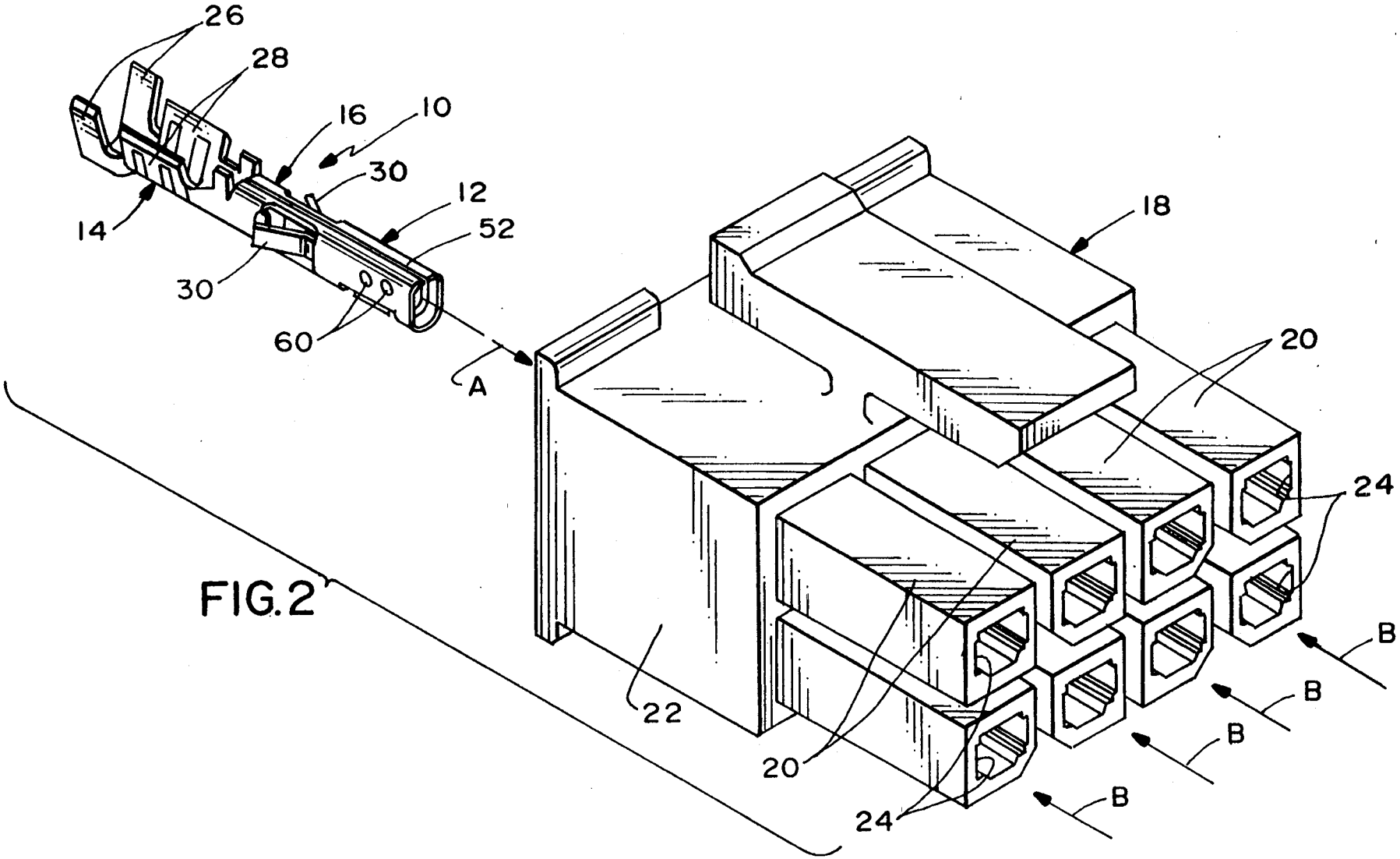
FIG. 2 is a perspective view of the female terminal in conjunction with a connector housing.

Female terminal 10 is adapted for rear insertion into an electrical connector housing, generally designated 18, as seen in FIG. 2 and as indicated by arrow "A". The connector housing is constructed for receiving a plurality of the female terminals (eight terminals in the illustrated embodiment). When the female terminals are fully inserted into connector housing 18, the mating ends 12 of the terminals are located within respective ones of a plurality of silos 20 projecting forwardly of the connector housing, and the terminating ends 14 of the terminals are located within a rear body portion 22 of the connector housing. Male terminal pins (not shown) are mounted in a mating connector housing (not shown), whereby the male terminal pins are inserted into through passages 24 at the front of silos 20, in the direction of arrows "B", and into the mating ends 12 of the female terminals disposed within the silos.

The female terminals are stamped and formed from sheet metal material, and terminating ends 14 are constructed for crimping onto stripped electrical wires. More particularly, the terminating end of each female terminal includes a rear pair of crimp arms 26 for crimping onto the outer insulation of an electrical wire, along with a forward pair of crimp arms 28 for crimping onto a stripped or exposed end of the conductor or conductive core of the wire.

Intermediate portion or section 16 of each female terminal 10 includes a pair of stamped and formed locking arms 30 which project outwardly from opposite sides of the terminal. The locking arms are cantilevered rearwardly and resiliently snap behind locking shoulders on the inside of connector housing 18 to prevent the terminals from backing out of the housing, opposite the direction of arrow "A". The intermediate section also may include a pair of upwardly projecting tabs 32 which engage stop shoulders within the connector housing to define the fully inserted position of the female terminal and also to stabilize the terminal within the housing against torsional or rotational movement about the longitudinal axis of the terminal.

Figure 3:
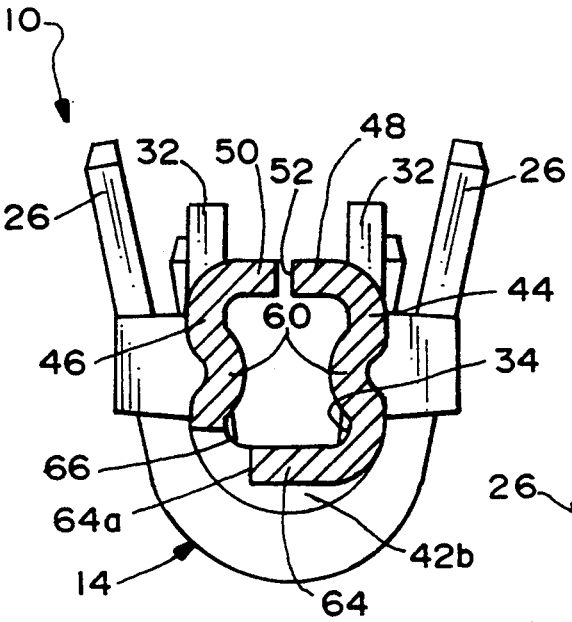
FIG. 3 is a vertical section, on an enlarged scale, taken generally along line 3—3 of FIG. 1.

Referring to FIG. 3 in conjunction with FIG. 1, mating end or portion 12 of each female terminal 10 defines an improved torsional body having a terminal-receiving passageway 34 adapted to receive a male terminal (described below in relation to FIG. 4). The mating end includes a front U-shaped cross sectional portion, generally designated 40, and a rear generally U-shaped cross sectional portion, generally designated 42, respectively defining the front and rear of passageway 34. Front U-shaped cross sectional portion 40 is defined by a pair of legs **40*a* joined by a bight portion 40*b*. Rear U-shaped cross sectional portion 42 is defined by a pair of legs 42*a* joined by a bight portion 42*b*. The mating end 12 of the terminal further includes two spaced apart side walls 44 and 46 extending lengthwise of passageway 40 and connecting the legs of the cross sectional portions. Specifically, side walls 44 and 46 connect legs 40*a* and 42*a* of U-shaped cross sectional portions 40 and 42, respectively. As seen in FIG. 3, the top of the mating end is defined by a top wall consisting of inwardly turned portions 48 and 50 of side walls 44 and 46, respectively, defining an open seam or slit 52 therebetween. In essence, the inwardly turned portions 48 and 50 which define the top wall are effective to form guiding means to prevent a male terminal from leaving passageway 34** from the top thereof.

It should be understood that such terms as "top", "bottom" and the like are used herein and in the claims hereof as relative terms only, in order to provide a more clear and concise understanding of the invention. Such terms are not to be limiting, because the terminal of the invention is, in fact, omnidirectional in actual use, as is well known to any person skilled in the art.

Generally, side walls 44 and 46 of mating end 12 of female terminal 10 have inwardly projecting terminal-contacting means for engaging the male terminal received in passageway 34. More particularly, a pair of longitudinally spaced dimples 60 project inwardly from each side wall 44 and 46. The distance between the dimples on the opposite side walls, as seen best in FIG. 3, is less than the width of a male terminal. Therefore, referring to FIG. 4, it can be seen that a generally rectangular (square) male terminal or pin 62 has been inserted into female terminal 10 in engagement with the terminal-contacting means provided by dimples 60. It can be seen that side walls 44 and 46 have spread outwardly in the direction of arrows "C". In essence, the side walls have flexed outwardly about axes which are generally parallel to the longitudinal axis of the terminal. Consequently, all of the four dimples 60 (defined by the two pairs of dimples on the two side walls) pivot outwardly and apply uniform or individually equal pressure onto the sides of the male terminal. This is in contrast to the prior art described in the "Background", above wherein the side walls of the previous female terminals are generally cantilevered and spread apart about axes generally perpendicular to the longitudinal axis of the terminal, thereby spreading the longitudinally spaced dimples an unequal amount.

According to another aspect of the invention, generally, means are provided for biasing the male terminal 62 upwardly toward a more centered alignment with dimples 60. Specifically, a bottom wall 64 is integrally joined with the bottom of side wall 44 and extends generally perpendicular therefrom toward the other side wall 46. A free end **64*a* of the bottom wall forms a transverse opening 66 with side wall 46, between generally U-shaped cross sectional portions 40 and 42. As seen in FIG. 1, the front and rear of bottom wall 64 is spaced from cross sectional portions 40 and 42. In essence, the bottom wall forms a tongue projecting across the bottom of the mating end of the female terminal, the tongue being free to flex transversely upwardly of the terminal. Preferably, bottom wall 64 does not extend all the way to side wall 46**, so that the side wall does not block upward flexing movement of the bottom wall.

Figure 4:
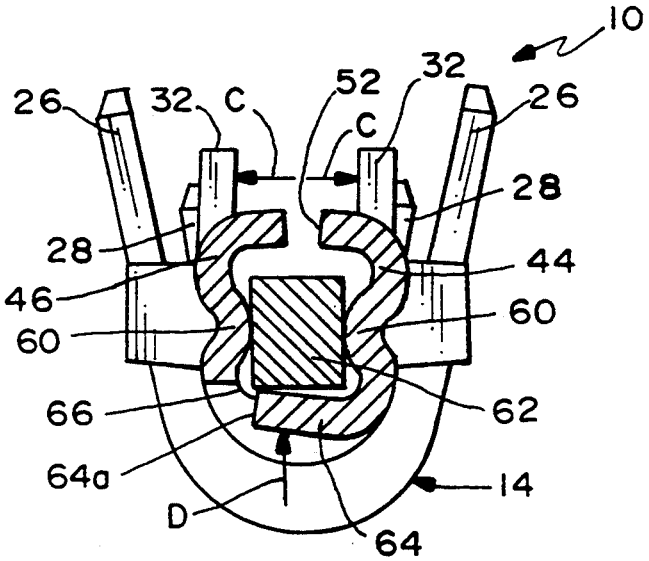
FIG. 4 is a view similar to that of FIG. 3, with a male terminal pin inserted into the female terminal.

Therefore, with reference to FIG. 4, it can be understood that, as side walls 44 and 46 flex outwardly in the direction of arrows "C", bottom wall 64, being integral with side wall 44, will flex upwardly in the direction of arrow "D" and drive male terminal 62 upwardly in the direction of arrow "D" to a more centered alignment with dimples 60.

Figure 7:
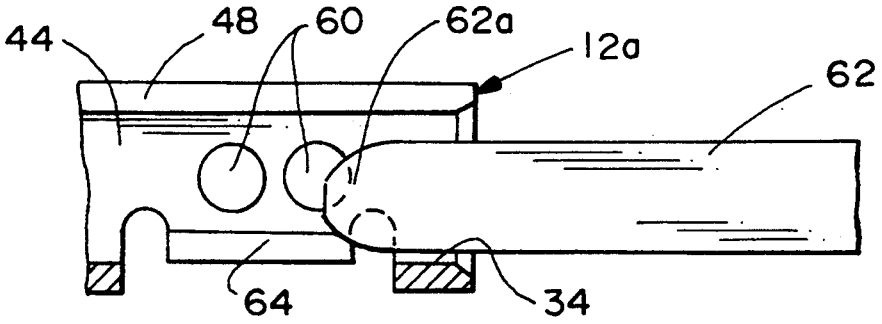
FIG. 7 is a view similar to that of FIGS. 5 and 6, with the male terminal pin being inserted near the bottom of the female terminal.
Figure 5:
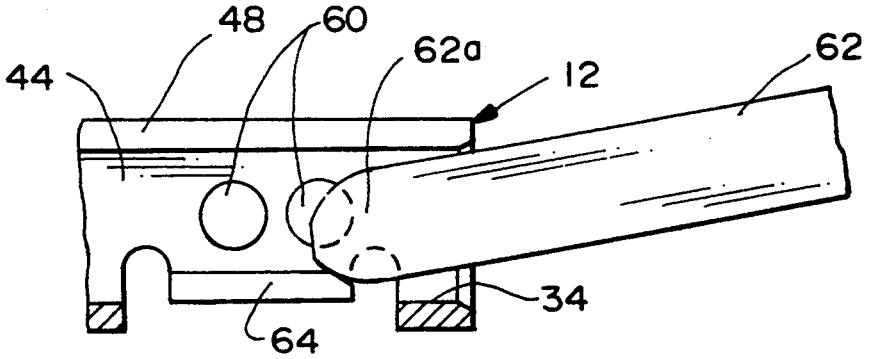
FIG. 5 is a fragmented axial section through the mating end of the female terminal, illustrating a downwardly canted orientation of a male terminal pin being inserted into the female terminal.
Figure 6:
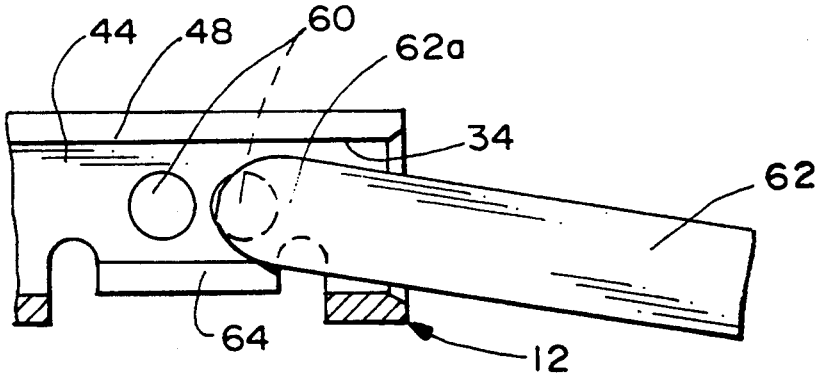
FIG. 6 is a view similar to that of FIG. 5, with the male terminal pin being inserted at an upwardly canted orientation.

The centering function of bottom wall 64 might be understood further by reference to FIGS. 5–7. FIG. 5 shows a male terminal 62 being inserted into mating end 12 of female terminal 10, with the male terminal in a downwardly canted orientation. As the forward end **62*a* of the male terminal enters the area between dimples 60, the male terminal will bias the side walls of the female terminal outwardly in the direction of arrows "C" (FIG. 4). This also causes bottom wall 64 to move upwardly in the direction of arrow "D". As the male terminal is fully inserted into the female terminal, and the male terminal assumes a more in-line orientation with passage 34, bottom wall 64 will maintain the male terminal more centered with respect to dimples 60**.

FIG. 6 shows a situation where a male terminal 62 is inserted into mating end 12 of female terminal 10 in an upwardly canted orientation. In this instance, as the forward end 62*a* of the male terminal engages dimples 60 to spread the side walls of the female terminal, the bottom wall 64 again will bias the male terminal upwardly toward a more centered position with respect to the dimples.

FIG. 7 shows a situation wherein male terminal 62 is inserted near the bottom of passageway 34. Again, as the forward end 62*a* of the male terminal engages dimples 60, side walls 44 and 46 will flex outwardly, causing bottom wall 64 to flex upwardly and center the male terminal in alignment with the dimples.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a generally elongate female electrical terminal which includes an improved torsional mating portion having a terminal-receiving passageway adapted to receive a male terminal, including two longitudinally spaced generally U-shaped cross sectional portions defining the front and rear of the passageway, and each U-shaped cross sectional portion being defined by a pair of legs joined by a bight portion, wherein the improvement comprises:

two spaced apart side walls extending lengthwise of the passageway and connecting the legs of the cross sectional portions, each side wall having inwardly projecting terminal-contacting means for engaging a male terminal received in the passageway, the distance between said contacting means being less than the width of the male terminal; and a bottom wall extending generally perpendicular from one of the side walls toward and generally perpendicular to the other side wall, with a free end of the bottom wall forming a transverse opening with the other side wall intermediate the U-shaped cross sectional portions, front and rear portions of the bottom wall being spaced from the cross sectional portions;

whereby said side walls are resiliently flexed outwardly away from each other about generally longitudinal axes when a male terminal is inserted into the passageway causing the free end of said bottom wall to flex upwardly forcing the male terminal, inserted into the passageway, upwardly so that the male terminal is in more centered alignment with the terminal contacting means.

2. In a generally elongate female electrical terminal as set forth in claim 1, including a top wall extending from one or both of said side walls forming guiding means to prevent the male terminal from leaving the passageway from the top thereof.

3. In a generally elongate female electrical terminal as set forth in claim 1, wherein said inwardly projecting terminal contacting means on each side wall includes two longitudinally spaced points of contact.

* * * * *